US007463849B2

(12) United States Patent
Takuma et al.

(10) Patent No.: US 7,463,849 B2
(45) Date of Patent: Dec. 9, 2008

(54) IMAGE FORMING APPARATUS INCLUDING STATIC PRE-ELIMINATOR

(75) Inventors: Yasuo Takuma, Ibaraki (JP); Masashi Yamamoto, Ibaraki (JP); Masanari Fujita, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 333 days.

(21) Appl. No.: 11/337,463

(22) Filed: Jan. 24, 2006

(65) Prior Publication Data

US 2006/0165438 A1 Jul. 27, 2006

(30) Foreign Application Priority Data

Jan. 25, 2005 (JP) ..... P2005-016222

(51) Int. Cl.
*G03G 21/00* (2006.01)

(52) U.S. Cl. ..... 399/128

(58) Field of Classification Search ..... 399/127, 399/128

See application file for complete search history.

(56) References Cited

U.S. PATENT DOCUMENTS 6,553,196 B2 * 4/2003 Inoue ..... 399/128

FOREIGN PATENT DOCUMENTS

| | | |
|---|---|---|
| JP | 3-52058 | 8/1991 |
| JP | 6-348112 | 12/1994 |
| JP | 10-198132 | 1/1998 |

* cited by examiner

*Primary Examiner*—William J Royer
(74) *Attorney, Agent, or Firm*—McGinn IP Law Group, PLLC

(57) ABSTRACT

An image forming apparatus includes a photosensitive member being movable in a predetermined direction; a charging roller that charges a surface of the photosensitive member; and a static pre-eliminator that eliminates static electricity by irradiating the surface of the photosensitive member with light, the static pre-eliminator located on an upstream side of the charging roller in a direction of movement of the photosensitive member; wherein an arrangement and an exposure amount of the static pre-eliminator are set to satisfy $E \leqq 0.025 \times \exp(t/\tau)$ where $\tau$ is a residual time constant of a photo carrier generated in the photosensitive member by the static pre-eliminator, t is a time period from a time when the photosensitive member passes through the static pre-eliminator to a time when the photosensitive member is charged by the charging roller, and E is a normalized exposure amount of the static pre-eliminator.

5 Claims, 4 Drawing Sheets

IMAGE FORMING APPARATUS INCLUDING STATIC PRE-ELIMINATOR

BACKGROUND OF THE INVENTION

1. Field of the Invention

The present invention relates to an image forming apparatus such as an electrophotographic printer, a copying machine, and the like.

2. Description of the Related Art

A corona charging method for charging a surface of a unidirectionally rotating photosensitive member with a predetermined potential V0 by corona discharge is used widely in an image forming apparatus such as an electrophotographic printer, a copying machine, and the like. Although the corona charging method has excellent characteristic of electrostatically charging the photosensitive member uniformly, the corona charging method has a problem that the method requires a countermeasure for a great deal of ozone generated at the time of generation of corona because a high DC voltage of about 4to 6kV is used.

For this reason, there has been proposed a contact charging method in which a desired charged potential can be obtained by use of a relatively low voltage while the amount of ozone generated is extremely small.

The contact charging method is a method for electrostatically charging the surface of the photosensitive member by applying a relatively low voltage to a charging means which is disposed so as to come into direct contact with the photosensitive member.

The contact charging method is classified into an AC type and a DC type. In the AC type, an AC voltage or an AC/DC superposed voltage is applied to the charging means as disclosed in JP-B-3-52058. In the DC type, a DC voltage is applied to the charging means as disclosed. in JP-A-6-348112 and JP-A-10-198132.

The AC type achieves uniform electrostatic charging in spite of generation of a very small amount of ozone (approximately 1/10 to 1/100 compared with the corona charging method) and has a high capacity for removing the potential hysteresis of the photosensitive member. For this reason, the AC type has an advantage in that the scale of configuration of the electrophotographic apparatus as a whole can be reduced without necessity of any static eliminating process before the electrostatic charging process but has a disadvantage in that vibratory noise is generated in a nip portion by an AC electric field because an AC voltage is used.

On the other hand, the DC type is apt to make electrostatic charging so uneven that stripe-like electrostatic charging irregularity reaching 200 mm at maximum may be generated in a direction perpendicular to a direction of movement of a charged surface. For this reason, there is a problem that a white-striped image defect (the phenomenon that white stripes appear in solid black or half tone) occurs in the case of a charged area development, and that a black-striped image defect occurs in the case of a discharged area development.

In the contact charging method, the photosensitive member is electrostatically charged on the basis of gap discharge at gaps on opposite sides of the position of contact between the photosensitive member and a charging roller. It is difficult to charge the photosensitive member evenly because a large number of factors such as the relative dielectric constant of the photosensitive member, the applied voltage, the film thickness,and the like have relation to the gap discharge phenomenon in terms of characteristic of the charging mechanism.

To solve the problem, several proposals have been made.

For example, JP-A-6-348112 has reported the knowledge that selection of dark potential of the photosensitive member in a range from 300 to 650 V permits uniform charging. According to JP-A-6-348112, there is a report that when the dark potential of the photosensitive member is selected to be not higher than 650 V, an air gap can be controlled within a certain range to stabilize charging to thereby achieve a success in uniform charging free from any striped image in terms of total charging characteristic in the same manner as in the case where a pulsating voltage is applied. It is however indicated that contrast to bright potential cannot be taken so that a problem of reduction in density and a problem of fogging or the like occur in charged area development and discharged area development respectively when the dark potential of the photosensitive member is not higher than 300 V.

To pay attention to the fact that a discharge is not stabilized when discharge is performed at gaps on both upstream and downstream sides of the position of contact between the photosensitive member and the charging roller, there has been also proposed a method in which charging is performed only at the downstream gap.

In this method, it is however necessary to accurately irradiate the upstream gap portion with a large quantity of light in order to perfectly eliminate static electricity at the gap located in the upstream side in the direction of movement of the photosensitive member. A photo carrier generated in the photosensitive member by light irradiation may remain after passage through the nip portion to thereby eliminate static electricity at the upstream gap. There is a problem that charging efficiency becomes down.

On the other hand, JP-A-10-198132 has disclosed a method in which the surface of the photosensitive member is charged with a predetermined potential by discharge at the upstream gap portion so that necessary charging is performed at only the upstream gap. According to JP-A-10-198132, there is a disclosure that uniform charging can be performed when a pre-exposure means for clearing the surface potential of the photosensitive member is provided on the upstream side of the position of contact between the charging roller and the photosensitive member while satisfying $L/v \geqq \tau$ in which L (mm) is the distance between the most downstream point of an irradiation region due to the pre-exposure means and the charging start point of the charging roller, v (mm/sec) is the moving velocity of the photosensitive member, and $\tau$ is the lifetime of the photo carrier generated in the photosensitive member by the pre-exposure means.

SUMMARY OF THE INVENTION

According to the present inventor's examination, it is confirmed that stripe-like charging irregularity may occur sometime even in the case where a dark potential of the photosensitive member is selected to be in a range from 300to 650 V though charging of the photosensitive member can be made uniform by the method disclosed in JP-A-6-348112 (Patent Document 2) compared with the background art. It is also proved that the method of accelerating charging at the downstream gap of the charging roller spoils uniformity of charging as a whole to cause a tendency toward a rough image in printing of a halftone image compared with the method of accelerating charging at the upstream gap of the charging roller.

According to the inventor's examination, it is proved that one of the causes of occurrence of stripe-like charging irregularity is microscopic change in the state of contact between the charging roller and the photosensitive member on the basis of a slip-stick phenomenon in the nip section where the charging roller and the photosensitive member come into contact with each other after charging at the upstream gap.

That is, because the time required for the charging roller's passing through the nip portion changes, the amount of charge accumulated in the surface of the charging roller becomes uneven in accordance with the place. Accordingly, a portion charged and a portion not charged are generated at the downstream gap just after the charging roller passes through the nip portion, so that stripe-like charging irregularity occurs.

It is proved that this phenomenon occurs remarkably particularly in the case where the photosensitive member is a soft medium such as a belt photosensitive member. It is also proved that this phenomenon depends on a specific resistance value of the charging roller.

When the specific resistance value of the charging roller is high, the amount of charge accumulated in the surface of the charging roller runs short. At the upstream gap, the electric field in the gap cannot reach the discharge start electric field, so that charging is performed only at the downstream gap to which the sufficient electric field in the gap is applied after the charging roller passes through the nip portion. In this case, change in electric field in the gap with the passage of time is added by the peeling operation of the charging roller and the photosensitive member, so that the surface of the photosensitive member is charged with a high potential. When the photosensitive member is a soft medium such as a belt photosensitive member, the peeling operation is so microscopically uneven that charging is apt to be uneven.

On the other hand, when the specific resistance of the charging roller is low, charge is accumulated in the surface of the charging roller sufficiently up to the upstream gap. Accordingly, because the electric field in the gap is not lower than the discharge start electric field, discharge occurs at the upstream gap. As a result, the surface of the photosensitive member is charged with a predetermined potential, so that discharge does not occur at the downstream gap portion.

The discharge at the upstream gap is more stable than that at the downstream gap because change in the gap length acts as change in a direction of stopping of discharge. Accordingly, the surface of the photosensitive member can be charged stably.

On the other hand, when the specific resistance of the charging roller is low, charge is accumulated in the surface of the charging roller sufficiently up to the upstream gap. Accordingly, because the electric field in gap is not lower than the discharge start electric field, discharge occurs at the upstream gap. As a result, the surface of the photosensitive member is charged with a predetermined potential, so that discharge does not occur at the downstream gap portion.

The discharge at the upstream gap is more stable than that at the downstream gap because change in gap length acts as change in a direction of stopping of discharge. Accordingly, the surface of the photosensitive member can be charged stably.

On the other hand, when the specific resistance value of the charging roller is middle, that is, when discharge occurs at the downstream gap in addition to discharge at the upstream gap, stripe-like charging irregularity does not occur if discharge at the upstream and downstream gaps is generated evenly in any place of the charging roller. It is however confirmed that when the state of contact between the charging roller and the photosensitive member in the nip section microscopically changes on the basis of the slip stick phenomenon as described above, discharge at the downstream gap is generated unevenly in accordance with the place so that stripe-like charging irregularity occurs.

The present invention has been made in view of the above circumstances and provides an image forming apparatus which is configured so that charging at the upstream gap is accelerated on the basis of the examination to thereby suppress occurrence of stripe-like charging irregularity to form an image free from image turbulence.

According to an aspect of the present invention, there is provided an image forming apparatus including: a photosensitive member being movable in a predetermined direction; a charging roller that charges a surface of the photosensitive member with a predetermined potential, the charging roller disposed so as to come into contact with the surface of the photosensitive member; and a static pre-eliminator that eliminates static electricity from the surface of the photosensitive member by irradiating the surface of the photosensitive member with light, the static pre-eliminator located in an upstream side of the charging roller in a direction of movement of the photosensitive member; wherein an arrangement and an exposure amount of the static pre-eliminator are set to satisfy $E \leqq 0.025 \times \exp(t/\tau)$ where $\tau$ is a residual time constant of a photo carrier generated in the photosensitive member by the static pre-eliminator, t is a time period from a time when the photosensitive member passes through the static pre-eliminator to a time when the photosensitive member is charged by the charging roller, and E is a normalized exposure amount of the static pre-eliminator which is obtained by normalizing the exposure amount of the static pre-eliminator by half-value exposure amount of the photosensitive member.

According to another aspect of the present invention, there is provided an image forming apparatus including: a photosensitive member being movable in a predetermined direction; a charging roller that charges a surface of the photosensitive member with a predetermined potential, the charging roller disposed so as to come into contact with the surface of the photosensitive member; and a static pre-eliminator that eliminates static electricity from the surface of the photosensitive member by irradiating the surface of the photosensitive member with light, the static pre-eliminator located in an upstream side of the charging roller in a direction of movement of the photosensitive member; wherein an arrangement and an exposure amount of the static pre-eliminator are set to satisfy $E \leqq 0.025 \times \exp(10 \times t)$ where t is a time period from a time when the photosensitive member passes through the static pre-eliminator to a time when the photosensitive member is charged by the charging roller, and E is a normalized exposure amount of the static pre-eliminator which is obtained by normalizing the exposure amount of the static pre-eliminator by half-value exposure amount of the photosensitive member.

BRIEF DESCRIPTION OF THE DRAWINGS

Embodiments of the present invention will be described in detail based on the following figures, wherein.

DETAILED DESCRIPTION OF THE INVENTION

Figure 1:
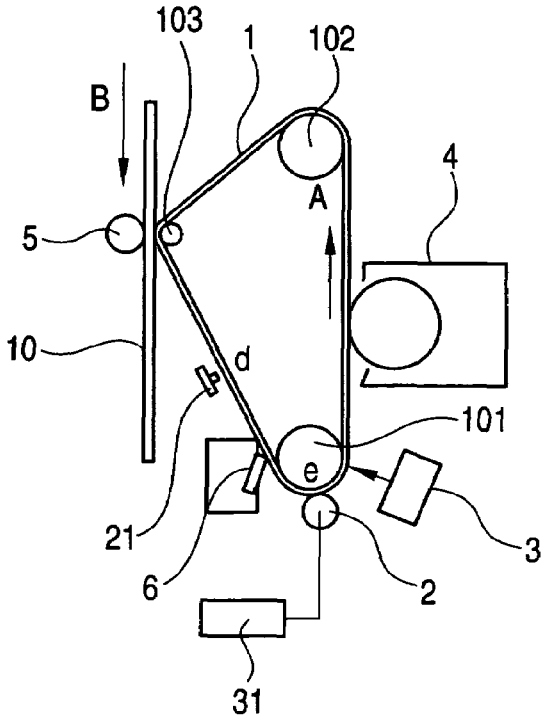
FIG. 1 is a schematic configuration view showing an embodiment of an image forming apparatus according to the invention.

An embodiment of the invention will be described below with reference to the drawings. FIG. 1 is a schematic configuration view of an image forming apparatus according to the invention. A belt-like photosensitive member 1 is laid on a drive roller 101 and driven rollers 102 and 103. A charging roller 2, an exposure device 3, a developing device 4, a transfer device 5, an erasing device 21 as a static pre-eliminator and a cleaning device 6 are disposed successively along a direction of rotation of the photosensitive member 1 as represented by the arrow A in FIG. 1.

A photo carrier is generated in the photosensitive member 1 irradiated with light emitted from the erasing device 21 which is a static pre-eliminator, so that the potential of a surface of the photosensitive member 1 just before the charging roller 2 is initialized to a predetermined potential. The charging roller 2 is disposed so that an electrically conducting rubber roller comes into contact with the photosensitive member 1. The charging roller 2 is formed so that the rubber roller is driven to rotate as the photosensitive member 1 travels.

A DC power supply 31 is electrically connected to the charging roller 2. The potential of the surface of the photosensitive member 1 is electrostatically charged with a predetermined potential VO by application of a voltage not lower than a discharge start voltage. In this embodiment, the potential VO of the surface of the photosensitive member 1 is selected to be −400 V.

The exposure device 3 exposes the surface of the photosensitive member 1 to light in accordance with an image information signal. As a result, an electrostatic latent image is formed on the surface of the photosensitive member 1. The developing device 4 supplies toner onto the electrostatic latent image of the photosensitive member 1 to form a visible image. Further, the transfer device 5 transfers the visible image on the photosensitive member 1 onto a sheet of paper 10 carried in a direction of the arrow B from a paper hopper not shown.

The toner image transferred onto the sheet of paper 10 is carried to a fixing device not shown. In the fixing device, the toner image is fixed on the sheet of paper 10. On the other hand, after the transferring operation, the surface of the photosensitive member 1 is irradiated with light by the erasing device 21. Static electricity is eliminated from the surface of the photosensitive member 1 up to a predetermined potential by the photo carrier generated by the light irradiation. After a part of the toner which is not transferred onto the sheet of paper 10 by the transferring operation but remains on the photosensitive member 1 is cleaned by the cleaning device 6, the photosensitive member 1 is electrostatically charged with the predetermined surface potential VO by the charging roller 2 again. This process is repeated.

Although the photosensitive member 1 is generally composed of an electrically conducting support and a photosensitive layer formed on the support, the electrically conducting layer may be grounded or a predetermined potential may be applied. In the case where a predetermined potential is applied, a superposed voltage of a control voltage and the predetermined voltage is applied to the charging roller 2. In this embodiment, the electrically conducting layer of the photosensitive member 1 is grounded so that the potential of the electrically conducting layer becomes zero.

In the apparatus configured as described above, the embodiment of the present invention is characterized in that the specific resistance value of the charging roller 2 and the amount of exposure of the erasing device 21 are selected to be predetermined values. These will be described below in detail.

(Specific Resistance Value of Charging Roller 2)

Figure 8:
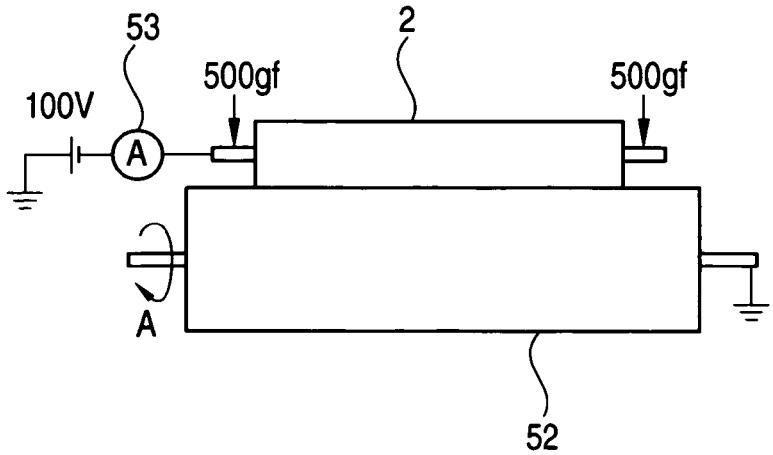
FIG. 8 is a view showing the configuration of an apparatus for measuring the specific resistance value of the charging roller.

The specific resistance value of the charging roller 2 is measured as shown in FIG. 8. That is, a load of 500 gf is applied on opposite ends of a shaft of the charging roller 2 to press the charging roller 2 against a cylindrical metal electrode 52. While the metal electrode 52 is rotated at a predetermined circumferential velocity, a DC voltage of 100 V is applied to the shaft portion of the charging roller 2. An electric current flowing in the charging roller 2 after the passage of 30 seconds is measured with an ampere meter 53. The specific resistance value of the charging roller 2 is calculated on the basis of the measured current. In this embodiment, the current is measured on the assumption that the diameter of the metal electrode 52 is 0.03 (m), the circumferential velocity of the metal electrode 52 is 0.2 (m/s), the nip area between the charging roller 2 and the metal electrode 52 is $1.6\times10^{-4}$ ($m^2$), and the distance between the shaft of the charging roller 2 and the surface of the metal electrode 52 is $2\times10^{-3}$ (m).

Figure 7:
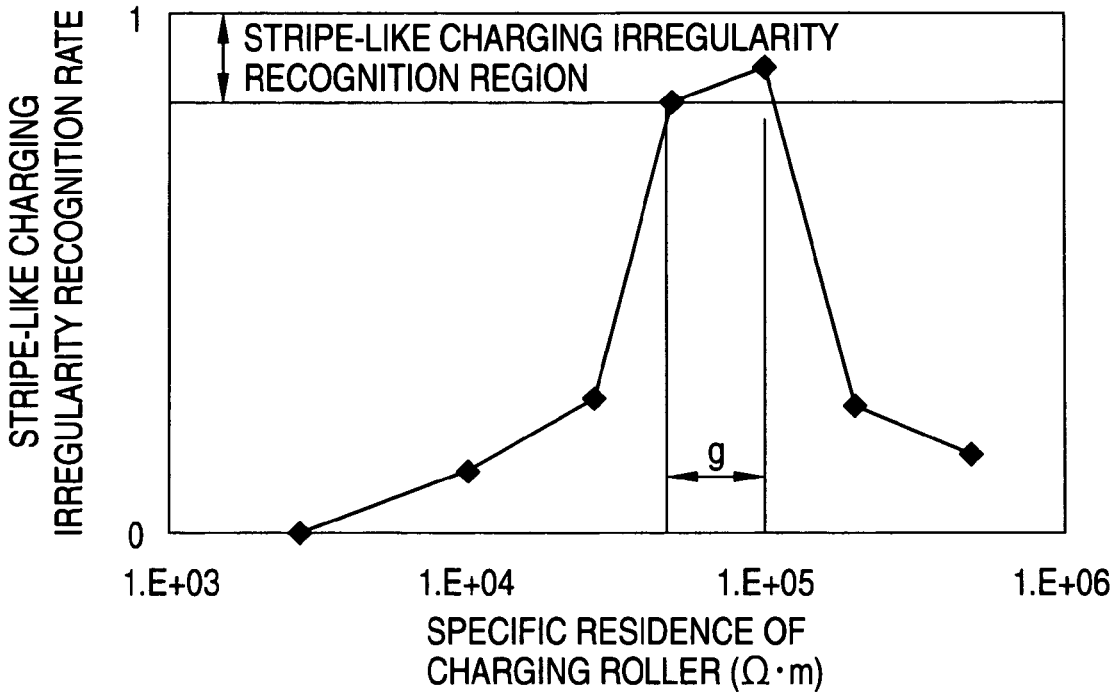
FIG. 7 is an explanatory graph showing the relation between the specific resistance value of a charging roller and occurrence of charging irregularity.

FIG. 7 shows an experimental result of examination of the relation between the specific resistance value of the charging roller 2 measured by the method and the situation of occurrence of stripe-like charging irregularity in the photosensitive member 1. In FIG. 7, the horizontal axis expresses the specific resistance (Ω·cm) of the charging roller 2, and the vertical axis expresses the recognition rate of stripe-like charging irregularity.

Incidentally, in this experiment, evaluation is made in the condition that the erasing device 21 is removed to eliminate the influence of the photo carrier due to the erasing device 21. According to this experiment, though stripe-like charging irregularity is not recognized when the specific resistance value of the charging roller 2 is low, stripe-like charging irregularity is recognized when the specific resistance value of the charging roller 2 increases to about $5\times10^4$ (Ω·cm). There is obtained a result that stripe-like charging irregularity is recognized in a region g, that is, in a specific resistance region of from $5\times10^4$ to $1\times10^5$ (Ω·cm) but the stripe-like charging irregularity is not recognized when the specific resistance value becomes higher than $1\times10^5$ (Ω·cm).

This phenomenon suggests that the discharge at a gap on the upstream side of a point of contact between the photosensitive member 1 and the charging roller 2 is dominant when the specific resistance value of the charging roller 2 is lower than $5\times10^4$ (Ω·cm), and that discharge at a gap on the downstream side of the contact point is dominant when the specific resistance value of the charging roller 2 is higher than $1\times10^5$ (Ω·cm). Therefore, the stripe-like charging irregularity can be avoided when the specific resistance value of the charging roller 2 is selected to be out of the region g. When a specific resistance value higher than the region g is selected, the surface of the photosensitive member 1 is however electrostatically charged with a higher potential because charging is made only at the downstream gap so that change in electric field in the gap with the passage of time is added by the peeling operation of the charging roller 2 and the photosensitive member 1. In the case of a soft medium such as the belt photosensitive member 1, the peeling operation is so microscopically uneven that charging is apt to be uneven. It is therefore preferable that the region in which discharge at the upstream gap is dominant, that is, the charging roller 2 having a specific resistance value lower than $5\times10^4$ (Ω·cm) is used.

(Amount of Exposure of Erasing Device 21)

Even in the case where the specific resistance value of the charging roller 2 is selected to be not higher than the predetermined value as described above, discharge at the downstream gap is apt to be accelerated because electric charge in the surface of the photosensitive member 1 electrostatically charged at the upstream gap is erased in the nip section if there is a photo carrier generated by exposure due to the erasing device 21.

To prevent the acceleration of discharge, not only the residual time constant of the generated photo carrier but also the residual amount of the photo carrier per se finally in the vicinity of the charging roller 2 must be reduced to be not larger than a predetermined value.

Table 1 shows an experimental result in the case where the erasing device 21 is attached.

TABLE 1

| Amount of Exposure E (relative value) | Time t (sec) | | | | |
|---|---|---|---|---|---|
| | 0.156 | 0.258 | 0.345 | 0.482 | 0.573 |
| 0.00 | 0 | 0 | 0 | 0 | 0 |
| 0.08 | 0 | 0 | 0 | 0 | 0 |
| 0.17 | x | 0 | 0 | 0 | 0 |
| 0.25 | x | 0 | 0 | 0 | 0 |
| 0.33 | x | 0 | 0 | 0 | 0 |
| 0.42 | x | x | 0 | 0 | 0 |
| 0.50 | x | x | 0 | 0 | 0 |
| 0.58 | x | x | 0 | 0 | 0 |
| 0.67 | x | x | 0 | 0 | 0 |
| 0.75 | x | x | 0 | 0 | 0 |
| 0.83 | x | x | x | 0 | 0 |
| 1.67 | x | x | x | 0 | 0 |
| 2.50 | x | x | x | 0 | 0 |
| 3.33 | x | x | x | x | 0 |
| 4.17 | x | x | x | x | 0 |
| 5.00 | x | x | x | x | 0 |
| 5.83 | x | x | x | x | 0 |
| 6.67 | x | x | x | x | 0 |
| 7.50 | x | x | x | x | 0 |
| 8.33 | x | x | x | x | x |

Table 1 shows the amount of exposure of the surface of the photosensitive member 1 to light emitted from the erasing device 21 in the case where the residual time constant τ of the photo carrier is 0.1 (s), in the column direction. Although the amount of exposure is generally expressed in $J/m^2$, an amount of exposure E is now expressed by a value obtained by normalizing the amount of exposure of the surface of the photosensitive member 1 by an amount of exposure required for reducing the charged potential of the photosensitive member 1 by half, that is, a half-value exposure amount in order to consider the photosensitive characteristic of the photosensitive member 1.

The time t (s) required for moving the photosensitive member 1 from an exposure point d in the erasing device 21 to a charging point e of the charging roller 2 is taken in the row direction. In this embodiment, the charging roller 2 having a specific resistance value of $1\times10^4$ (Ω·cm) is used.

In Table 1, the symbol 0 indicates the case where charging irregularity did not occur, and the symbol × indicates the case where charging irregularity occurred.

Figure 2:
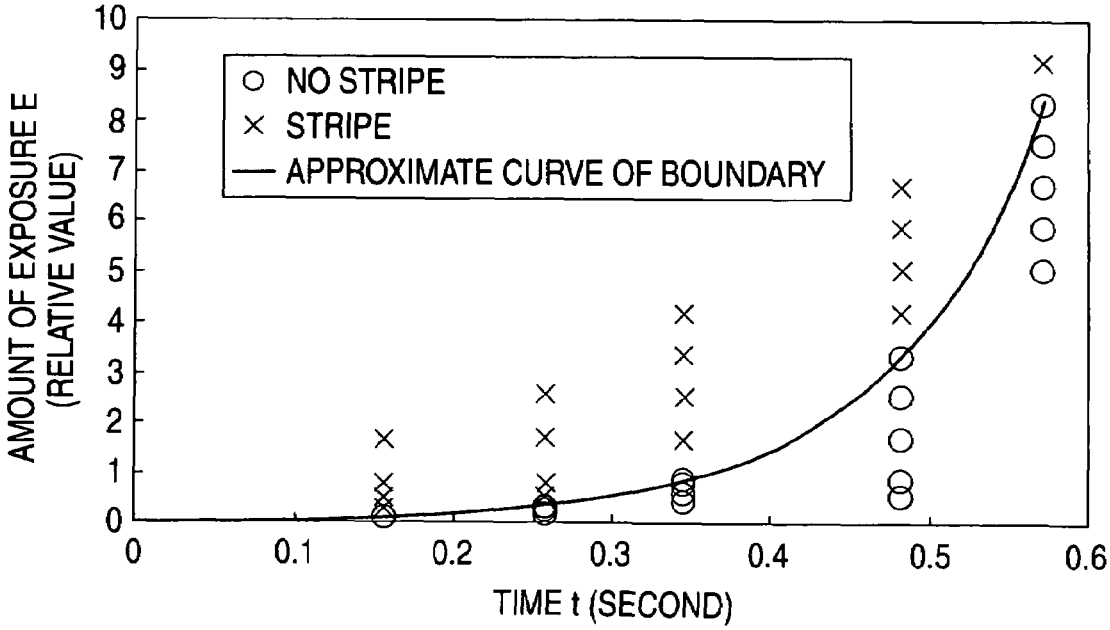
FIG. 2 is an explanatory graph showing the relation among the moving velocity of a photosensitive member, the amount of exposure to light emitted from a static pre-eliminator and the situation of occurrence of charging irregularity.

FIG. 2 shows the experimental result of Table 1. In FIG. 2, the horizontal axis expresses time t, and the vertical axis expresses amount of exposure E. The boundary between the region (0) where stripe-like charging irregularity does not occur and the region (×) where stripe-like charging irregularity occurs is expressed in curve.

This curve can be approximated by the following expression 1.

$$E=E0\times\exp(t/\tau) \qquad \text{Expression 1}$$

Incidentally, E0 is calculated as E0=0.025 on the basis of the curve shown in FIG. 2. This value is a constant value which is an irradiation-enabled upper limit (residual upper limit of the photo carrier) at the charging point e of the charging roller 2 and which does not change even in the case where the residual time constant τ of the photo carrier of the photosensitive member 1 changes.

Next, the experimental result in the case of τ=0.3 (s) is shown in Table 2.

TABLE 2

| Amount of Exposure E (relative value) | Time t (sec) | | | | |
|---|---|---|---|---|---|
| | 0.156 | 0.258 | 0.345 | 0.482 | 0.573 |
| 0.00 | 0 | 0 | 0 | 0 | 0 |
| 0.08 | X | X | X | 0 | 0 |
| 0.17 | X | X | X | X | X |
| 0.25 | X | X | X | X | X |
| 0.33 | X | X | X | X | X |
| 0.42 | X | X | X | X | X |
| 0.50 | X | X | X | X | X |
| 0.58 | X | X | X | X | X |
| 0.67 | X | X | X | X | X |
| 0.75 | X | X | X | X | X |
| 0.83 | X | X | X | X | X |
| 1.67 | X | X | X | X | X |
| 2.50 | X | X | X | X | X |
| 3.33 | X | X | X | X | X |
| 4.17 | X | X | X | X | X |
| 5.00 | X | X | X | X | X |
| 5.83 | X | X | X | X | X |
| 6.67 | X | X | X | X | X |
| 7.50 | X | X | X | X | X |
| 8.33 | X | X | X | X | X |

Also in Table 2, the amount of exposure of the surface of the photosensitive member 1 to light emitted from the erasing device 21 is taken in the column direction. An amount of exposure E is now expressed by a value obtained by normalizing the amount of exposure of the surface of the photosensitive member 1 by the half-value exposure amount. The time t (s) required for moving the photosensitive member 1 from the exposure point d in the erasing device 21 to the charging point e of the charging roller 2 is taken in the row direction. Also in this experiment, the specific resistance value of the charging roller 2 is selected to be $1\times10^4$ (Ω·cm).

Figure 6:
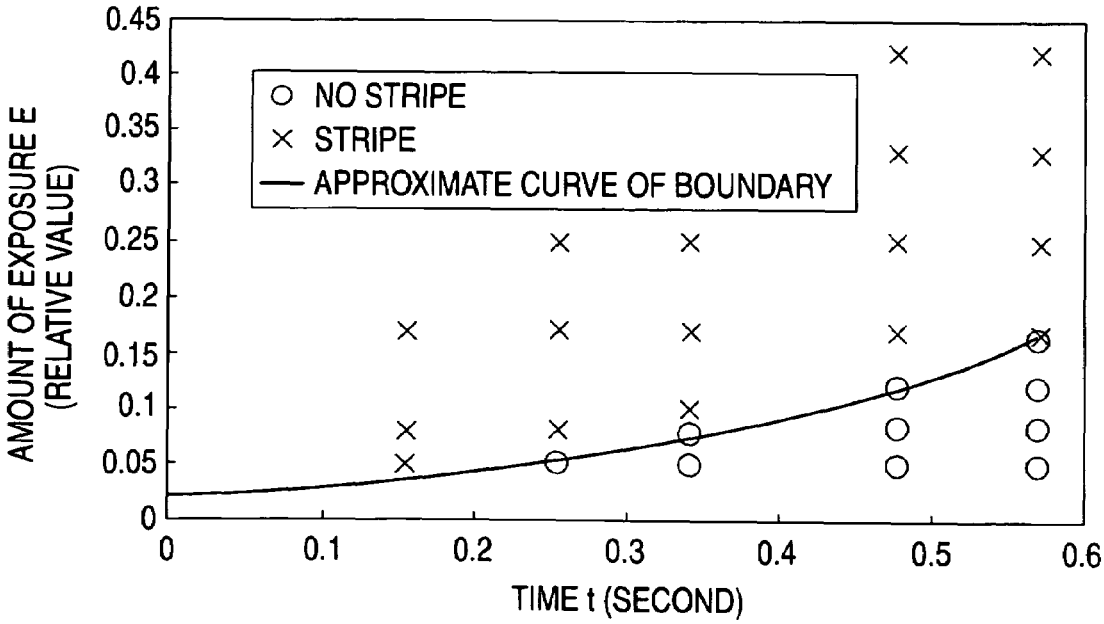
FIG. 6 is an explanatory graph showing the relation among the moving velocity of the photosensitive member, the amount of exposure to light emitted from the static pre-eliminator and the situation of occurrence of charging irregularity.

In Table 2, the symbol 0 indicates the case where charging irregularity did not occur, and the symbol × indicates the case where charging irregularity occurred. FIG. 6 shows the experimental result of Table 2. In FIG. 6, the horizontal axis expresses time t, and the vertical axis expresses amount of exposure E. The boundary between the condition (0) where stripe-like charging irregularity does not occur and the condition (×) where stripe-like charging irregularity occurs is expressed in curve. This curve is expressed by an approximate expression in the case where $\tau=0.3$ and $E0=0.025$ are put in the expression 1.

It is apparent from the experimental result that stripe-like charging irregularity can be removed when the arrangement of the erasing device 21 and the amount of exposure to light emitted from the erasing device 21 are set so that the amount of exposure E to light emitted from the erasing device 21 which is a static pre-eliminator satisfies the following expression 2.

$$E \leqq 0.025 \times \exp(t/\tau) \quad \text{Expression 2}$$

It is also confirmed that the case where $\tau$ is smaller than 0.1 (s), that is, the case where the following expression 3 is satisfied is more preferred because the region where charging irregularity does not occur is widened.

$$E \leqq 0.025 \times \exp(10 \times t) \quad \text{Expression 3}$$

Next, a method of measuring the residual time constant $\tau$ of the photo carrier of the photosensitive member 1 will be described.

Figure 3:
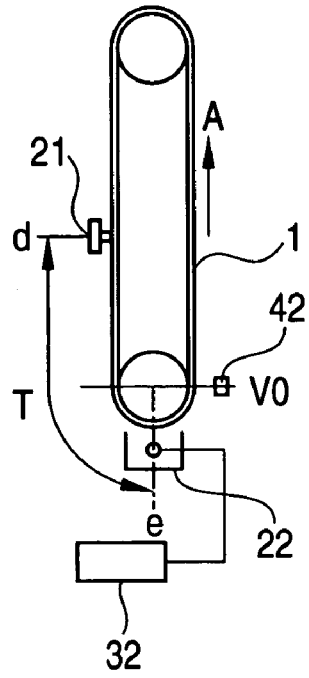
FIG. 3 is a view showing the configuration of an apparatus for measuring the residual time constant of a photo carrier of the photosensitive member.

FIG. 3 is a schematic view of a measuring apparatus for measuring $\tau$ in the photosensitive member 1. A corona charging device 22, an erasing device 21 and a surface potential measuring sensor 42 of the photosensitive member 1 are disposed around the photosensitive member 1 rotating in the direction of the arrow A in FIG. 3. The corona charging device 22 is not in contact with the photosensitive member 1. The erasing device 21 is located on the upstream side of the corona charging device 22. The surface potential measuring sensor 42 is located on the downstream side of the corona charging device 22.

Figure 4:
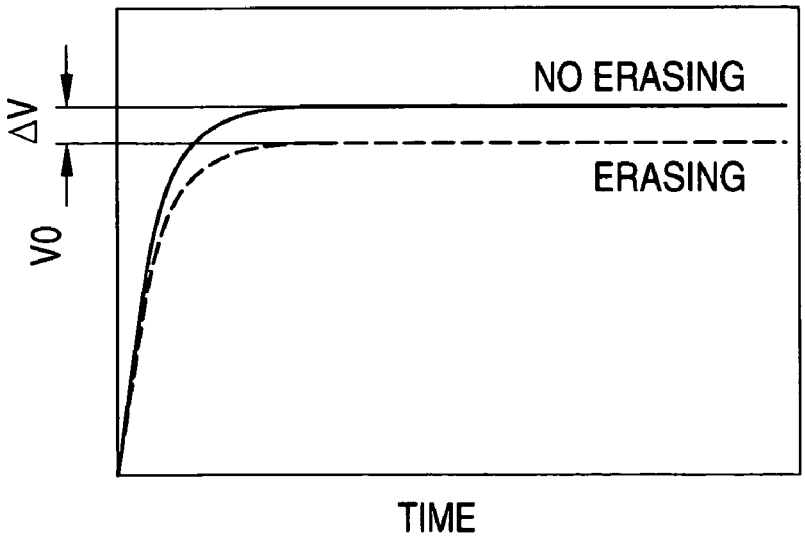
FIG. 4 is an explanatory graph showing a method of measuring the residual time constant of the photo carrier of the photosensitive member.

The procedure of measurement is as follows. First in the condition that there is no exposure to light emitted from the erasing device 21, the photosensitive member 1 is rotated. Then, a power supply 32 connected to the corona charging device 22 is turned on to start charging the photosensitive member 1. In this condition, the dark potential V0 in a circle section of the photosensitive member 1 is measured with the sensor 42. FIG. 4 shows change in dark potential V0 of the photosensitive member 1 with the passage of time on this occasion. Time is taken in the horizontal axis and dark potential V0 is taken in the vertical axis. In FIG. 4, the solid line shows change in dark potential V0 in the case where there is no exposure.

Then, the photosensitive member 1 is left until the surface potential of the photosensitive member 1 reaches about 0 V. Then, the photosensitive member 1 is rotated again. The erasing device 21 and the power supply 32 connected to the corona charging device 22 are turned on to start irradiation of the photosensitive member 1 with erasing light and charging of the photosensitive member 1. In this condition, the dark potential V0 in the circle section of the photosensitive member 1 is measured with the sensor 42.

FIG. 4, the broken line shows change in dark potential V0 of the photosensitive member 1 with the passage of time on this occasion. The dark potential is reduced by $\Delta V$ compared with the case where there is no erasing light. The potential difference $\Delta V$ represented by a distance between the solid line and the broken line is generated by remaining ones of the photo carriers, generated in the photosensitive member 1 by irradiation with erasing light. The potential difference $\Delta V$ can be expressed by the following expression 4 in which $\tau$ is the residual time constant of the photo carrier of the photosensitive member 1, and T (s) is the time required for moving the surface of the photosensitive member 1 from the exposure point d in the erasing device 21 to the charging point e of the corona charging device 22 in FIG. 3.

$$\Delta V \propto \exp(-T/\tau) \quad \text{Expression 4}$$

Figure 5:
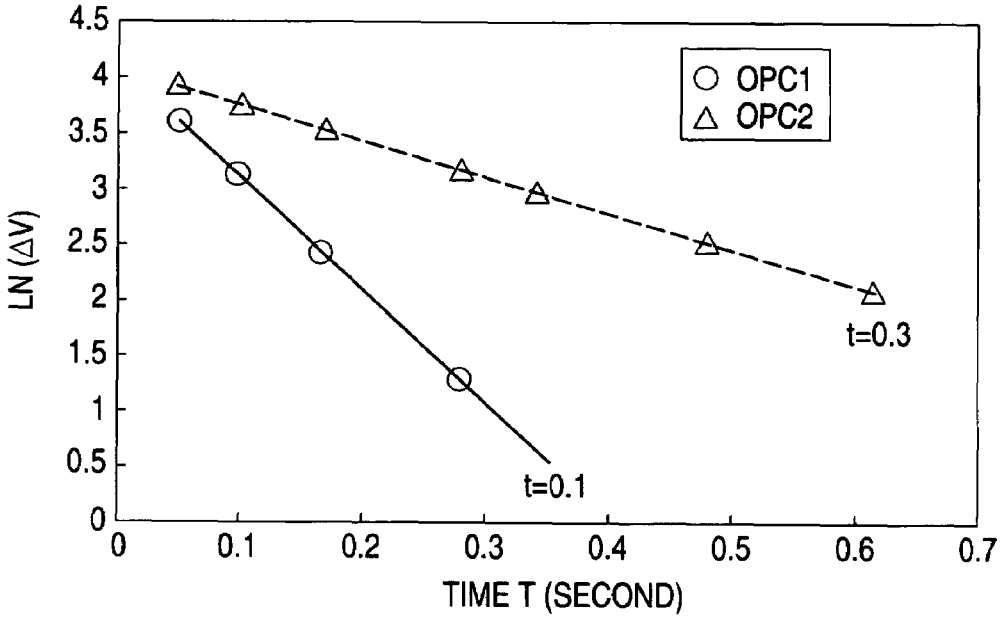
Fig.5 is an explanatory graph showing the method of measuring the residual time constant of the photo carrier of the photosensitive member.

In the condition that the position of the exposure point d is changed to change the moving time T on the assumption that the amount of exposure to light emitted from the erasing device 21 is kept constant, the value of $\Delta V$ at that time is examined. A result shown in FIG. 5 is obtained. In FIG. 5, the moving time T of the photosensitive member 1 between d and e is taken in the horizontal axis and $\Delta V$ is taken in the vertical axis. Two kinds of photosensitive paper OP1 and OP2 are used in this experiment.

Although $\Delta V$ decreases linearly in accordance with change in the moving time T, the residual time constant $\tau$ of the photo carrier in each of the two kinds of photosensitive paper OP1 and OP2 is calculated on the basis of the inclination of $\Delta V$. In this example, the residual time constant $\tau$ in photosensitive paper OP1 is 0.1 whereas the residual time constant $\tau$ in photosensitive paper OP2 is 0.3.

As is obvious from the above description, in accordance with the embodiment of the present invention, the use of the charging roller 2having a specific resistance value lower than $5\times10^4$ ($\Omega\cdot$cm) under an environment with guaranteed temperature and humidity can accelerate stable discharge at the gap on the upstream side of the point of contact between the photosensitive member 1 and the charging roller 2 to accelerate uniform charging of the surface of the photosensitive member 1. Erasing of the charged potential of the photosensitive member 1 in the nip section is suppressed because the arrangement of the erasing device 21 and the amount of exposure to light emitted from the erasing device 21 are set to satisfy the expression 2 in which $\tau$ is the residual time constant of the photo carrier generated in the photosensitive member 1 by the erasing device 21 as a static pre-eliminator, t is the time required for moving the photosensitive member 1 from the exposure point d in the erasing device 21 to the charging point e of the charging roller 2, and E is a normalized exposure amount of the erasing device 21 which is obtained by normalizing the amount of exposure of the erasing device 21 by the half-value exposure amount of the photosensitive member 1. As a result, there can be achieved an image forming apparatus which can form a high-quality image free from image turbulence. The entire disclosure of Japanese Patent Application No. 2005-016222filed on Jan. 25, 2005 including specification, claims, drawings and abstract is incorporated herein by reference in its entirety.

What is claimed is

1. An image forming apparatus, comprising:

a photosensitive member being movable in a predetermined direction;

a charging roller that charges a surface of the photosensitive member with a predetermined potential, the charging roller being disposed so as to come into contact with the surface of the photosensitive member; and a static pre-eliminator that eliminates static electricity from the surface of the photosensitive member by irradiating the surface of the photosensitive member with light, the static pre-eliminator being located on an upstream side of the charging roller in a direction of movement of the photosensitive member;

wherein an arrangement and an exposure amount of the static pre-eliminator are set to satisfy $$E \leqq 0.025 \times \exp(t/\tau)$$

where $\tau$ is a residual time constant of a photo carrier generated in the photosensitive member by the static pre-eliminator, t is a time period from a time when the photosensitive member passes through the static pre-eliminator to a time when the photosensitive member is charged by the charging roller, and E is a normalized exposure amount of the static pre-eliminator which is obtained by normalizing the exposure amount of the static pre-eliminator by half-value exposure amount of the photosensitive member.

2. The image forming apparatus according to claim 1, wherein the charging roller having a specific resistance value not higher than $5\times10^4$ Ω·cm is used under an environment with guaranteed temperature and humidity.

3. The image forming apparatus according to claim 1, wherein the photosensitive member has a belt-like shape.

4. An image forming apparatus, comprising:

a photosensitive member being movable in a predetermined direction;

a charging roller that charges a surface of the photosensitive member with a predetermined potential, the charging roller being disposed so as to come into contact with the surface of the photosensitive member; and a static pre-eliminator that eliminates static electricity from the surface of the photosensitive member by irradiating the surface of the photosensitive member with light, the static pre-eliminator being located on an upstream side of the charging roller in a direction of movement of the photosensitive member;

wherein an arrangement and an exposure amount of the static pre-eliminator are set to satisfy $$E \leqq 0.025\times\exp(10\times t)$$

where t is a time period from a time when the photosensitive member passes through the static pre-eliminator to a time when the photosensitive member is charged by the charging roller, and E is a normalized exposure amount of the static pre-eliminator which is obtained by normalizing the exposure amount of the static pre-eliminator by half-value exposure amount of the photosensitive member.

5. The image forming apparatus according to claim 4, wherein the charging roller having a specific resistance value not higher than $5\times10^4$ Ω·cm is used under an environment with guaranteed temperature and humidity.

* * * * *